United States Patent [19]

Flynn

[11] 3,947,932

[45] Apr. 6, 1976

[54] JEWELLERY CLASP

[75] Inventor: Alexander Flynn, Willowdale, Canada

[73] Assignee: Gozlan Brothers Limited, Toronto, Canada

[22] Filed: Apr. 5, 1974

[21] Appl. No.: 458,421

[52] U.S. Cl. ..... 24/230 CF; 24/230 SC

[51] Int. Cl.[2] ..... A44B 17/00

[58] Field of Search ..... 24/230 SC, 230 SL, 230 CF

[56] References Cited

UNITED STATES PATENTS

| | | | |
|---|---|---|---|
| 1,499,428 | 7/1924 | Wagner | 24/230 SC |
| 1,702,360 | 2/1929 | Myrberg | 24/230 CF |
| 2,178,572 | 11/1939 | Forstner | 24/230 CF |
| 3,308,517 | 3/1967 | Geldwerth | 24/230 CF |
| 3,739,433 | 6/1973 | Druskin | 24/230 SL |

FOREIGN PATENTS OR APPLICATIONS

| | | | |
|---|---|---|---|
| 331,486 | 9/1903 | France | 24/230 SC |
| 207,137 | 2/1909 | Germany | 24/230 SC |

*Primary Examiner*—Bernard A. Gelak
*Attorney, Agent, or Firm*—Weldon F. Green

[57] ABSTRACT

The present invention provides a jewellery clasp in which a latch is formed of a single piece of material folded back upon itself to form a U-shaped spring with an upstanding projection thereon, and a holder is formed of a single piece of material with base, sides and upper catch plate, the latter having an aperture into which the upstanding projection is engaged by the spring to fasten the clasp.

1 Claim, 5 Drawing Figures

JEWELLERY CLASP

This invention relates to a clasp for connecting the ends of articles of jewellery such as bracelets, watch-bands, necklaces and the like.

It is common in the design of articles of jewellery which are worn around the neck or on the wrist, and which therefore, need to be fastened or unfastened, that the two ends of the article be provided with a clasp by which they may readily be locked or released by the wearer. Since the wearer may often have to put on or take off this jewellery alone it is necessary that it be designed to allow easy operation behind the back such as in the case of a clasp for jewellery or by one hand in the case of a bracelet to be worn on the wrist. It is therefore important that the clasp be relatively easy to fasten, be relatively secure when in place, and be relatively easy to release when the wearer wishes to remove it.

The foregoing are objects of the invention herein disclosed.

It is also an additional object of this invention to provide a clasp which, while it is functional for the wearer, will also be of a design which will facilitate its easy manufacture.

The present invention serves the desirable functions and objects of such a jewellery clasp by providing a holder adapted to receive a latch formed into a spring and having a raised projection thereon adapted to engage into an aperture in the holder under the urging of the spring so as to lock the latch to the holder; the clasp being released by operation of an activating member to depress the spring and disengage the raised projection from the aperture.

The invention is best understood by reference to the following description of one embodiment of the invention and to the accompanying drawings in which.

Figure 1:
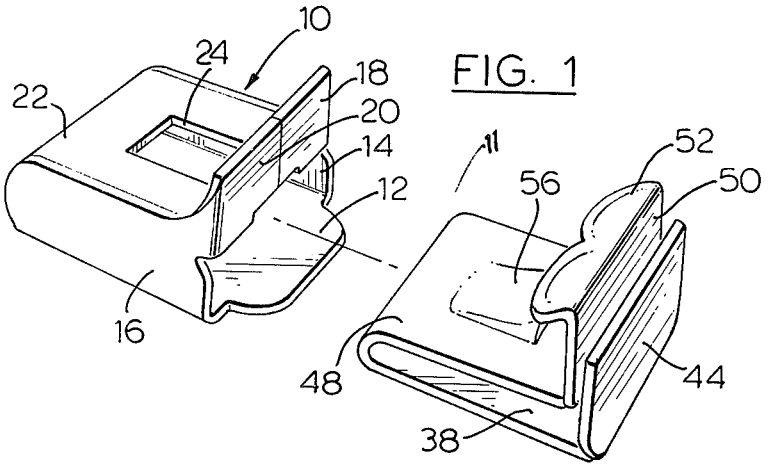
FIG. 1 is a prospective view of a clasp made in accordance with this invention comprising a holder and a latch.
Figure 2:
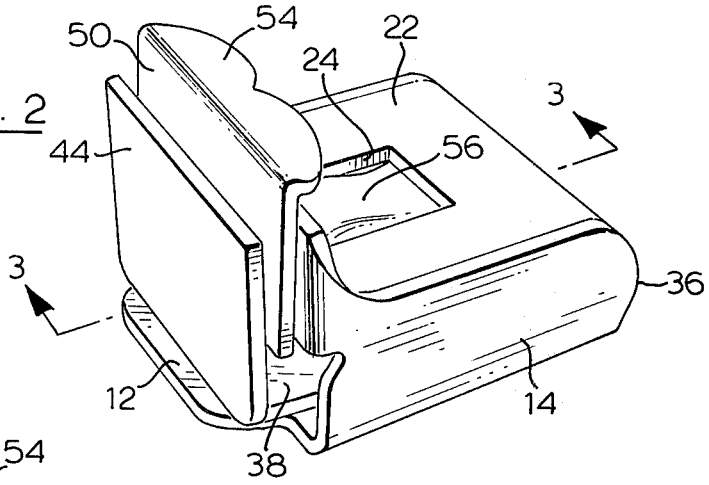
FIG. 2 is a prospective view of the clasp showing the latch inserted in the holder in the fastened position.

As can be seen in FIG. 1 the holder 10 is designed to provide a socket formation dimensioned to receive in matina relationship therewith the latch 11 which is adapted to be inserted therein, in the position illustrated in FIG. 2, through the rearward opening in the holder defined by the base 12, the sides 14 and 16, and the lower edges of the vertical walls 18 and 20.

Figure 4:
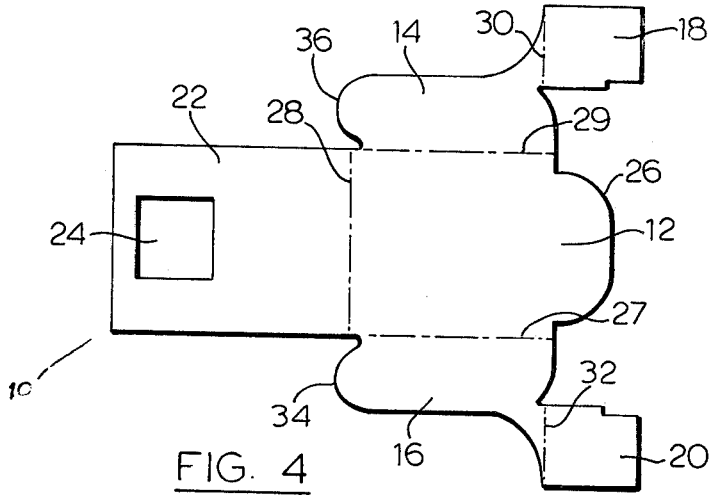
FIG. 4 shows the shape of the pattern of the holder before it is formed into the completed part after being cut from a piece of sheet material.

As illustrated in FIG. 4 this holder can be formed from a single piece cut from sheet material such as a suitable metal, in the pattern shown in FIG. 4 in which the base of the holder is defined by the rear edge 26 and the folding lines illustrated as dotted lines 27, 28 and 29. The sides 14 and 16 are contiguous with the base and formed with a smoothly curved forward edge 36 and 34 respectively and terminate in a rearward direction near the rearward edge of the base but short of the extremity of the curved rear edge of the base 26.

When the portions 14 and 16 are formed vertically by bending along the folding lines 29 and 27 they provide the sides as illustrated in FIG. 1.

Again referring to FIG. 4 the sides 14 and 16 have attached to the upper rearward portion thereof the walls 18 and 20 the lower edge of which is approximately the same level as the upper edge of the side portions. When bent along the folding lines illustrated at 30 and 32 these walls abut each other in the centre and form a vertical wall composed of the elements 18 and 20 as shown in FIG. 1.

Contiguous with the front edge of the base of the holder is a catch-plate 22 which, in the forming of the completed holder, is folded upwardly in a curved configuration coinciding with the shape of the forward edge of the sides 34 and 36 and then horizontally backward overlying the base in horizontal parallel configuration therewith extending rearward to approximately the plane of the vertical wall 18, 20. The catch-plate has an aperture 24 located midway between the sides of the catch-plate and nearer the rearward edge thereof. This aperture in the embodiment illustrated is square but need not necessarily be so. It is however as will be seen in the following description important that the rearward edge be formed so as to function in the manner necessary to hold the latch in place in the manner to be described hereinafter and a straight vertical edge is suitable to that end.

When the pattern of FIG. 4 is formed in the manner described it defines an enclosure with a bottom, sides, top and opening for the insertion of the latch therein.

Figure 5:
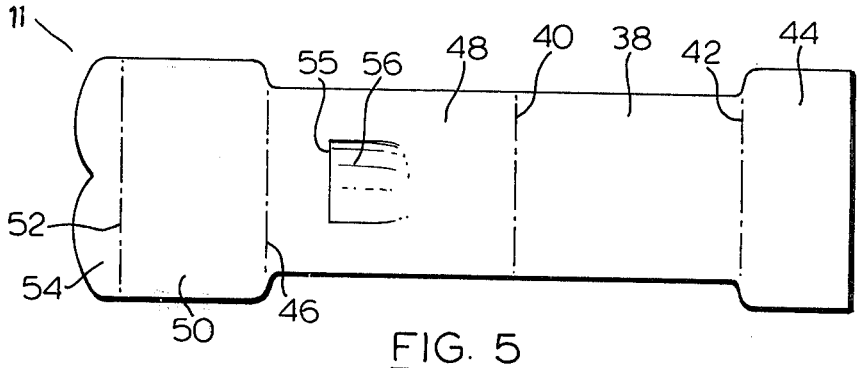
FIG. 5 shows the shape of the pattern of the latch before being formed into the completed part after being cut from a piece of sheet material.

Like the holder the latch of the clasp may be formed from a single piece of suitable sheet material such as any suitable metal in the pattern shown in FIG. 5. This pattern is a substantially elongated rectangular shape divided into five segments comprising the back-plate 44, the base 38, the spring portion of 48, the activating portion 50 and the thumb-plate 52.

Figure 3:
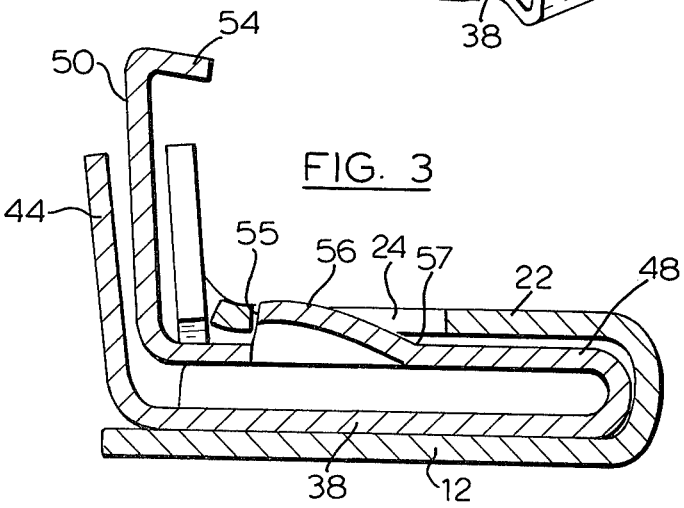
FIG. 3 is a vertical cross section of the clasp in the fastened position of FIG. 2.

The base of the latch is defined between the side edges and the forward edge delineated by the folding line illustrated by the broken line 40 and at the rear by the folding line illustrated by the dotted line 42. The back-plate is formed in position by bending along the line 42 so that the back-plate stands substantially vertically upward from the rearward edge of the base as shown in FIGS. 1, 2 and 3. The remainder of the latch is formed by bending the spring portion upwards in a smooth generally curved manner as seen in FIG. 1 at the forward edge of the base generally illustrated by the dotted folding line 40 in FIG. 5 and then rearward so that the spring portion overlies the base of the latch in substantially parallel relation thereto and spaced therefrom. The spring portion extends rearwardly just short of the back-plate 44. From the rear extremity of the spring portion 48 the activating portion is formed by bending along the line 42 so that the back-plate stands substantially vertically upward from the rearward edge of the base as shown in FIGS. 1, 2 and 3. The remainder of the latch is formed by bending the spring portion upwards in a smooth generally curved manner as seen in FIG. 1 at the forward edge of the base generally illustrated by the dotted folding line 40 in FIG. 5 and then rearward so that the spring portion overlies the base of the latch in substantially parallel relation thereto and spaced therefrom. The spring portion extends rearwardly just short of the back-plate 44. From the rear extremity of the spring portion 48 the activating portion is formed by bending along the folding line illustrated as 46 in FIG. 5 so that it stands substantially vertically upwards from the rearward or free end of the spring portion to a height extending above the upper edges of the back-plate 44 and the vertical walls 18 and 20.

To aid the manual operation the activating portion then is bent at approximately the folding line illustrated as 54 to form a horizontal portion 54 by which the operator of the clasp may exert pressure on the activating portion of the clasp. In FIG. 3 the relative height of the activating portion is illustrated as well as the relative vertical dimension of the forward part of the clasp which must be smaller than the internal dimension of the enclosure formed by the holder to allow insertion of the latch in the holder. Of course the lateral dimension of the base and spring portion of the latch will have to be slightly smaller than the internal dimension between the side walls 14 and 16 of the holder for the same reason. It is however an advantage if the latch is reasonably close to the dimensions of the holder so as to maintain the latch in a fairly consistent orientation in relation to the holder.

In the embodiment illustrated the back-plate and the activating portion have a lateral dimension slightly larger than the base or spring portion which gives those exposed portions of the latch (when the latch is in the fastened position) substantially the same overall dimensions as the holder.

To facilitate locking or holding the clasp in the fastened position illustrated in FIGS. 2 and 3 the spring portion of the latch is provided with a raised portion 56 located midway between the edges of the latch and slightly rearwardly of the centre of the spring portion. The raised portion is located and dimensioned so as to coincide with the square aperture of the catch-plate in the holder when the latch is inserted therein. Forming the latch so that the spring portion at the rear is spaced above the base of the latch slightly more than the internal dimension of the holder causes the spring portion to bear upwards within the holder so as to urge the raised portion 56 to engage into the aperture 24 to lock the latch to the holder as seen in FIG. 3. This resilient urging operation is assisted of course by the fact that the base of the latch 38 rests on the base of the holder 12. It also depends of course upon the latch being made of a material which has a bending resilience to cause it to act as a cantilever spring.

The raised portion 56 has a lateral dimension slightly less than the aperture, in fact sufficiently less that it will fit within the edges of the aperture in any orientation of the latch permitted by the relative dimensions of the latch and holder. The rearward extent of the raised portion terminates in a substantially vertical plane so that this rearward face 55 makes a substantially flat abutment against the rearward edge of the aperture 24. However the forward extension of the raised portion has a wedge like configuration sloping downwardly to the plane of the upper surface of the spring portion.

It will be appreciated that when the latch in the relaxed position shown in FIG. 1 is inserted forward and first into the opening of the holder the spring portion will be depressed by either or both of the upper surface of the spring portion or the upper surface of the raised portion 56 bearing against either the lower edges of the walls 18 and 20 or the under surface of the catch-plate 22 until the latch is substantially in the fastened position when the raised portion will be allowed to project into the aperture and the spring portion will be released upwards as far as may be allowed by the internal dimensions of the holder which may be governed either by the height of the catch-plate or the height of the lower edge of the walls 18 and 20. In this position the rear edge 55 of the raised portion will abut the rear edge of the aperture 24 to prevent withdrawal of the latch from the holder. When desired however the wearer may unfasten the clasp by pressing on the thumb-plate 54 with a thumb or finger so as to cause the activating portion 50 to depress the free end of the spring portion until the raised portion is disengaged from the aperture in which position the latch may be withdrawn from the holder.

It will be appreciated that the vertical walls 18 and 20 of the holder and the back-plate 44 of the latch can be utilized as convenient grips which aid the person using this clasp to operate it. For instance in fastening the clasp the latch may be inserted in the holder by the wearer placing the forefinger on the wall 18–20 and the back-plate 44 and pressing the latch into the holder. To unfasten the clasp the holder could hold the sides of the holder 14 and 16 with the thumb and finger while depressing the thumb-plate 54 with another finger.

It will also be appreciated that the curved rearward edge 26 of the base of the holder will aid in insertion of the latch when fastening the clasp. Placing the forward edge of the latch on this rearward lip will help to accurately locate the latch for insertion in the opening of the holder.

The sloping wedge shaped forward-extremity 57 of the raised portion 56 aids insertion of the latch since when the latch is pushed into the holder the sloping edge will contact the upper boundary of the entrance and cause the spring portion to be depressed as the latch is inserted however the vertical rearward limit of the raised portion does not permit withdrawal of the insert without specific disengagement by depression of the spring portion.

This clasp may be used for a variety of types of jewellery and only requires that the holder and latch be attached to the opposite ends of the piece of jewellery by any conventional mechanical or metallurgical means.

Although the embodiment described employs a raised portion on the latch and an aperture in the holder the locations of those items could be reversed and indeed other variations, such as a spring portion on the holder adapted to urge an aperture or a raised portion downward to engage a corresponding element on the latch, may be employed which differ from the embodiment herein described without departing from the invent of concept.

The embodiments of the invention in which an exclusive property or privilege is claimed are defined as follows:

1. In a jewelry clasp, a one-piece holder folded from a metal blank having an axis of symmetry including a U-shaped socket formation having a central axis and an axial access opening, said socket formation including a pair of longitudinally extending substantially parallel arms, said socket formation opening at one end thereof, thereby presenting an access opening, of one said arms having an aperture adjacent said one end, the sides of said other arm having upstanding walls extending toward said one arm thereby forming said socket formation, a one-piece latch folded from a metal blank having an axis of symmetry including a U-shaped band portion lowermost having upper and lower branches which are resiliently displaceable in relation to each other, said band being adapted to register under slight compression axially snugly within said socket formation through said access opening with the separated ends of the branches thereof located outermost beyond said access opening and extending at substantially right angles thereto to present a first upper longer arm portion in spaced relation to a second lower shorter arm portion, with said first arm portion presenting a finger-engaging ledge at the outer extremity thereof, said upper resiliently displaceable branch of said U-shaped band portion having an integral raised portion interengageable with said aperture for locking same together against separation only when in axial snug registration and releasable only upon downward displacement of said first upper arm portion for withdrawal, said holder presenting flange formations extending from the ends of said upstanding walls across the end of said one arm and upwardly of the edge portion of said access opening contiguous said first upper arm portion, with the outer extremity thereof spaced below said finger-engaging ledge whereby said first upper arm portion may be displaced downwardly for release of said interengageable means.

* * * * *